US006152308A

United States Patent [19]

Kreiser et al.

[11] Patent Number: 6,152,308

[45] Date of Patent: Nov. 28, 2000

[54] MOBILE CLASSIFIER FOR AGGREGATES

[75] Inventors: Clarence R. Kreiser, Myerstown; James F. Miller, Lebanon, both of Pa.

[73] Assignee: Marsulex Environmental Technologies, LLC, Lebanon, Pa.

[21] Appl. No.: 08/865,034

[22] Filed: May 29, 1997

[51] Int. Cl.[7] ..... B07B 1/49; B07B 1/55; B04B 3/00

[52] U.S. Cl. ..... 209/421; 209/137; 209/715

[58] Field of Search ..... 209/137, 142, 209/146–148, 12.1, 420, 421, 710, 715

[56] References Cited

U.S. PATENT DOCUMENTS

| | | | |
|---|---|---|---|
| 2,381,954 | 8/1945 | Hardinge | 209/710 |
| 2,910,178 | 10/1959 | Bonneau | 209/710 |
| 2,991,883 | 7/1961 | Hendricson et al. | 209/715 |
| 3,113,099 | 12/1963 | Schmitz | 209/148 |
| 4,227,997 | 10/1980 | Shaddock | 209/421 |
| 4,551,241 | 11/1985 | Saverse et al. | 209/710 |
| 4,785,761 | 11/1988 | Greenbank | 209/421 |
| 5,049,261 | 9/1991 | Tapp et al. | 209/421 |
| 5,234,564 | 8/1993 | Smith | 209/421 |

FOREIGN PATENT DOCUMENTS

| | | | |
|---|---|---|---|
| 1553667 | 10/1979 | United Kingdom | 209/421 |

*Primary Examiner*—Robert P. Olszewski
*Assistant Examiner*—Thuy V. Tran
*Attorney, Agent, or Firm*—Gary M. Hartman; Domenica N. S. Hartman

[57] ABSTRACT

A trailer mounts a first unit having an aggregate classifier and a pair of cyclones for pivotal movement between a generally horizontal storage position on the trailer and a generally vertical upright operational position on the trailer. A second unit having a second classifier and a second pair of cyclones is pivotally mounted on the trailer for movement between a generally horizontal storage position and a generally upright vertical operational position. In the storage positions, the units leave an open area in the middle of the trailer for storing and transporting ducts for use when operational. The duct work includes a riffle splitter "Y" duct for releasable securement to the aggregate inlets of the first and second classifiers in their upright position to provide a common aggregate inlet thereto. The ducts include a rectilinear duct for interconnecting the dust outlets of the cyclones when in their vertical operational position for channeling the dust to a baghouse.

20 Claims, 3 Drawing Sheets

MOBILE CLASSIFIER FOR AGGREGATES

TECHNICAL FIELD

The present invention relates to apparatus and methods for classifying particulate material, e.g., aggregates, and particularly to apparatus and methods for transporting and erecting one or more classifier and fines separation units at various job sites.

BACKGROUND

Traditional apparatus and methods for classifying materials include various types of fixed separation systems. Those systems are conventionally permanent installations and, typically the aggregates are transported to and from the permanent installations for purposes of classification. It will be appreciated that the handling of the aggregate materials, as well as their transportation to and from these permanent sites incurs substantial expenses in labor, vehicle operation, maintenance and travel time. As an example, the traditional method of sizing asphalt filler sands for highway projects uses conventional portable wash screens. Filler sand is washed by flooding the screen with water. The −200 mesh slurry is then pumped into settling ponds. The sand product has a moisture content which must then be dried prior to adding to the asphalt mixture. While this process has been found acceptable, its various disadvantages include the fuel expense of drying the wet material, the environmental impact of settling ponds. the requirement for trucking wash water to remote sites and generally the transportation of the aggregate to and from the sites. Even where dry particulate separation devices are employed at permanent sites, there is incurred the substantial additional cost in transportation, fuel and associated environmental problems.

DISCLOSURE OF THE INVENTION

In accordance with the present invention, there is provided a mobile system for classifying particulate material, e.g., aggregates, wherein one or more classifier and fines separation units can be transported to the job site on a trailer, for example, a flatbed trailer, and erected from a transport position into an operational position on the trailer in a half-day's time or less, thereby eliminating costly transportation of material, and costs associated with hydraulic sorting of the material, while affording advantages in reduced man-hours and downtime. When the job is completed, the unit may be readily and easily reconfigured on the trailer for conversion from the operational position to the transport position on the trailer. The mobile system is herein described with reference to classifying aggregate materials but it will be appreciated that other types of particulate material such as agricultural feed material may be classified using the present system.

In a preferred form of the present invention, a flatbed trailer is provided and carries one or more classifiers for separating materials at various mesh sizes. While most classifiers are amenable to the present invention, the present invention preferably employs a gravitational inertial classifier of known type such as a Buell classifier. This classifier has a classifier body having a chamber in the form of a half-heart shape. with a material feed inlet at the top and a finished product outlet at the bottom. Disposed at an angle to the gravitational path of movement of the feed material forming a feed material curtain along one side of the chamber is an air and fines outlet passage having classifying vanes opposite and adjacent to the curtain of falling aggregate material. Additionally, a primary air inlet is disposed along the falling curtain of aggregate. A primary fan induces air flow through the primary air inlet and aggregate inlet and into the classifier. As the curtain of material passes the vanes, the gas flow through the outlet creates a laminar flow condition which nearly reverses the direction of the downward gas flow, imparting the force required to move the fine particles (fines) into the gas stream and out of the chamber. Before passing through the vanes, however, a secondary air flow causes an eddy current of fine particles to sweep into the chamber and along the moving curtain of aggregate. Thus, the coarse particles not swept through the vanes are discharged through the lower outlet, while the fines are removed through the fines outlet including those fines picked off the coarse particles by the secondary air flow.

The fines are treated in a further separation process mounted on the trailer and employing cyclones to separate the fines from dust. With the classifier and cyclones of each of the one or more units thereof under negative pressure from an ancillary fan system, the fines are discharged from the cyclones for separation and the dust transferred to a baghouse for collection. It will be appreciated that both the classifier and cyclone separation constitute a dry particulate separation process.

In the preferred form of the present invention, one or more units, for example, of the foregoing type, with each unit including a classifier and a secondary separation system therefor, e.g., a cyclone, for separating fines and dust, is mounted on a flatbed trailer. Both the classifier system and the fines separation system are mounted on the trailer for unitary movement between a generally horizontal position for transport on the trailer to the job site and a vertical upright operational position on the trailer at the job site. More particularly, at least one classifier and one separator, e.g., a cyclone, are mounted on a single frame pivoted to the trailer bed. Thus, the classifier and cyclone are carried by the frame in a generally horizontal transport position and may be pivoted at the job site into an upright vertical position for operation. It will be appreciated that the fines outlet from the classifier is coupled by a duct to the fines inlet to the cyclone. Thus, at the job site, and with the addition of a separate portable baghouse provided on a separate trailer, the frame with the classifier and cyclone may be erected and a vacuum drawn through the classifier and fines separation systems for classifying the aggregates. Consequently, the present invention does away with costly transportation of aggregates to stationary classifying operations, eliminates the costs associated with hydraulic sorting methods arid offers additional savings in reduced man-hours and downtime.

More particularly, and in a preferred form, two classification and fines separation units, each unit including a classifier and two cyclone separators associated therewith, may be mounted on the trailer Led. Preferably, each classifier, together with an associated pair of cyclones, may be mounted on a frame pivoted to the trailer bed as a single unit. It will be appreciated that the frames and classifier and fines separation systems thus form a permanent part of the trailer. Additionally, the first and second frames may be mounted on the trailer bed at locations spaced from one another to define an area along the trailer bed for carrying a riffle splitter "Y" duct, as well as the cyclone outlet ducts. These ducts are secured to the flatbed and shipped on the trailer with the classification and fines separation systems to the job site. At the site, outriggers carried by the trailer are extended to engage the ground and stabilize the trailer. All of the tie-down chains and other tie-down straps and the like are removed. The riffle splitter "Y" ducts and cyclone outlet ducts are also removed from the trailer and set aside for final steps of system assembly, e.g., by a crane. Each combination classifier and associated fines separation system, e.g., one or more cyclones connected to the classifier, is then pivoted as an integral unit from the horizontal transport position into an upright operational position and secured on the trailer bed in that operational position. After both units are secured in place, the riffle splitter "Y" duct is lifted by the crane into position and secured to the classifiers to provide a common aggregate inlet for the classifiers. The cyclone dust outlet ducts are also raised and installed above the cyclones. The cyclone dust outlet ducts are then coupled to a separate baghouse, e.g., on a separate flatbed trailer. The separate flatbed also preferably mounts a fan for inducing a negative pressure in the classifiers and cyclones. The operation of the systems then proceeds as in conventional systems. At the conclusion of the job, the one or more units may be reconfigured on the trailer for transport to and operation after erection at another job site.

In a preferred embodiment according to the present invention, there is provided a mobile system for classifying particulate material, comprising a trailer, wheels mounted on the trailer for transporting the trailer to a job site and a first classification unit including a first classifier pivotally carried by the trailer for movement between a generally horizontal transport position on the trailer to an upright operational position on the trailer, the classifier having a system for classifying the particulate material including, in the operational position thereof, a material inlet at an upper end of the classifier for receiving the material, a discharge for discharging coarse particles of the material and a discharge for discharging fines, the first classification unit further including a first separator pivotally carried by the trailer for movement between a generally horizontal transport position on the trailer to an upright operational position on the trailer, the first separator having a fines separation system including an inlet for receiving fines from the lines discharge of the classifier, a discharge for discharging fines and a discharge for dust separated from the fines.

In a further preferred embodiment according to the present invention, there is provided a method of erecting a system for classifying particulate material having a material classifier and at least one cyclone mounted on a mobile trailer having wheels for transporting the system between job sites, the classifier having an inlet for receiving the material, a coarse material discharge and a fines discharge for discharging fines to the cyclone, comprising the steps of moving the wheeled trailer mounting the classifier and cyclone to a job site with the classifier and cyclone lying on sides thereof in a generally horizontal stored position on the trailer and, at the job site, moving the classifier and cyclone into an upright operational position on the trailer.

Accordingly, it is a primary object of the present invention to provide a novel and improved mobile classification system for separating aggregates which enables classification of dry particulate material at various job sites without costly transportation of aggregates and costs associated with hydraulic sorting methods.

BEST MODE FOR CARRYING OUT THE INVENTION

Figure 1:
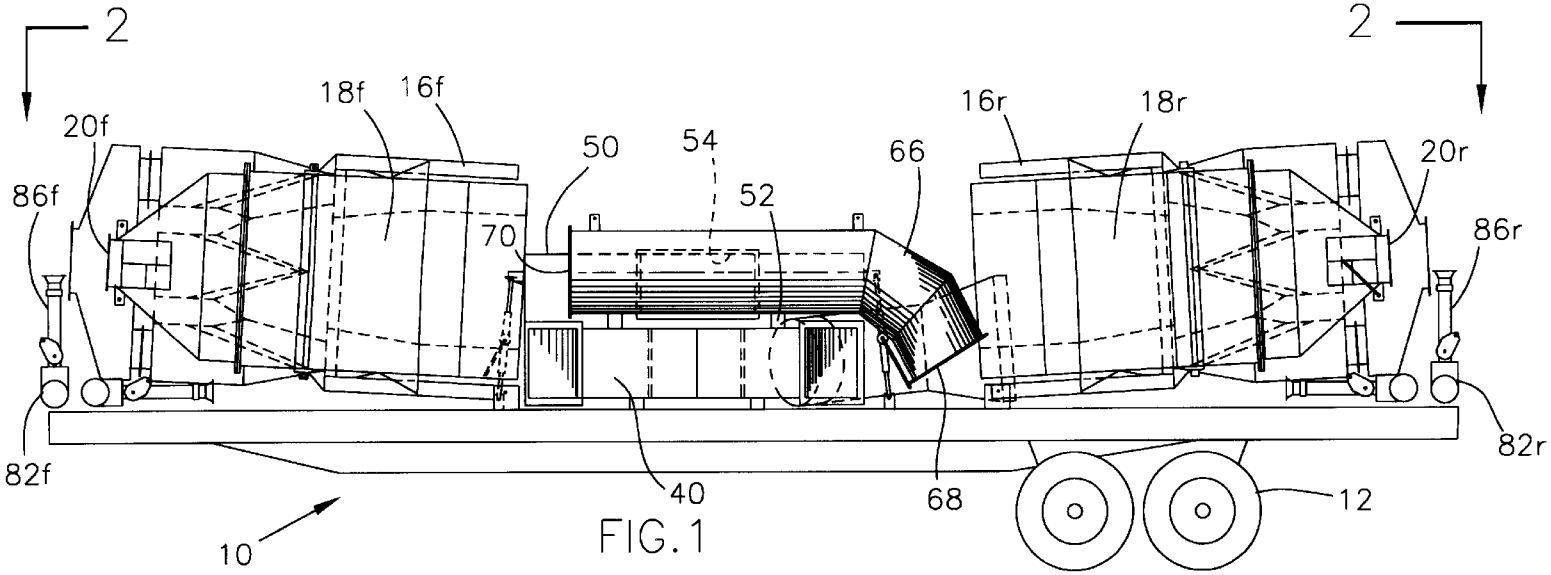
FIG. 1 is a side elevational view of a mobile system for classifying aggregates constructed according to the present invention.
Figure 2:
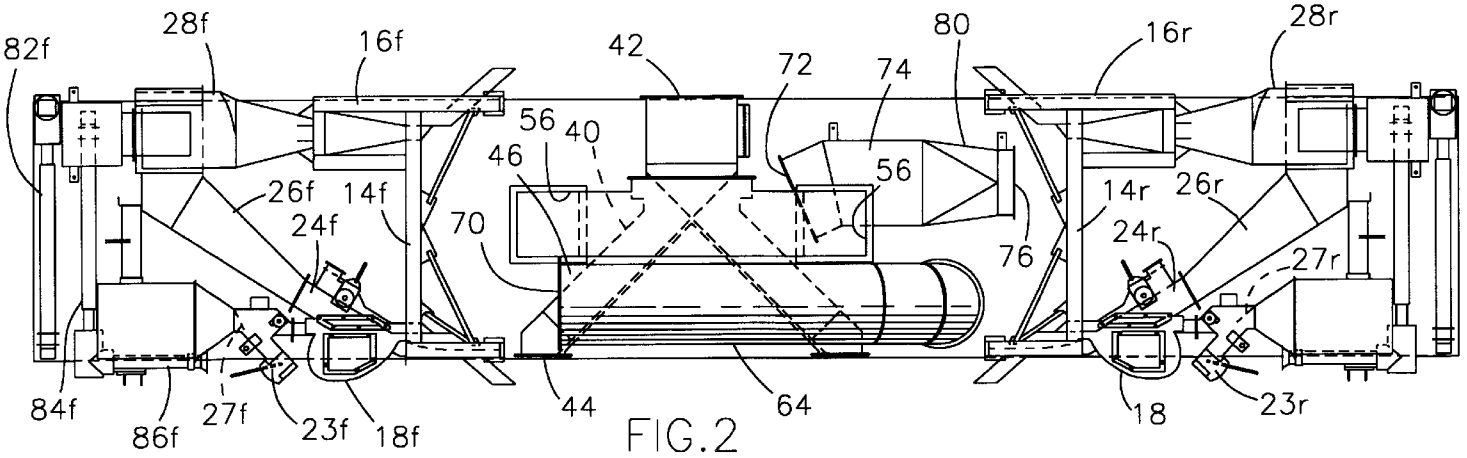
FIG. 2 is a top plan view thereof.

Referring now to the drawings, particularly to FIGS. 1 and 2, there is illustrated a trailer, generally designated 10, preferably a flatbed-type trailer, having wheels 12 and attachable to a cab for hauling the trailer between job sites. Permanently mounted on the trailer is an aggregate classifying system which includes as a single unit at east one classifier and an associated fines separation system, the latter preferably comprising a pair of cyclones. In a preferred form of the present invention, a pair of such units are mounted on the flatbed trailer 10. Each unit is identical to one another, except that they are mounted on the trailer in reverse directions. The systems will be described using identical numbers to identify like parts, with the numerals identifying parts of the unit at the forward end of the trailer being followed by the suffix "f" and the numerals identifying the parts of the unit mounted on the rearward portion of the trailer followed by the suffix "r."

Figure 3:
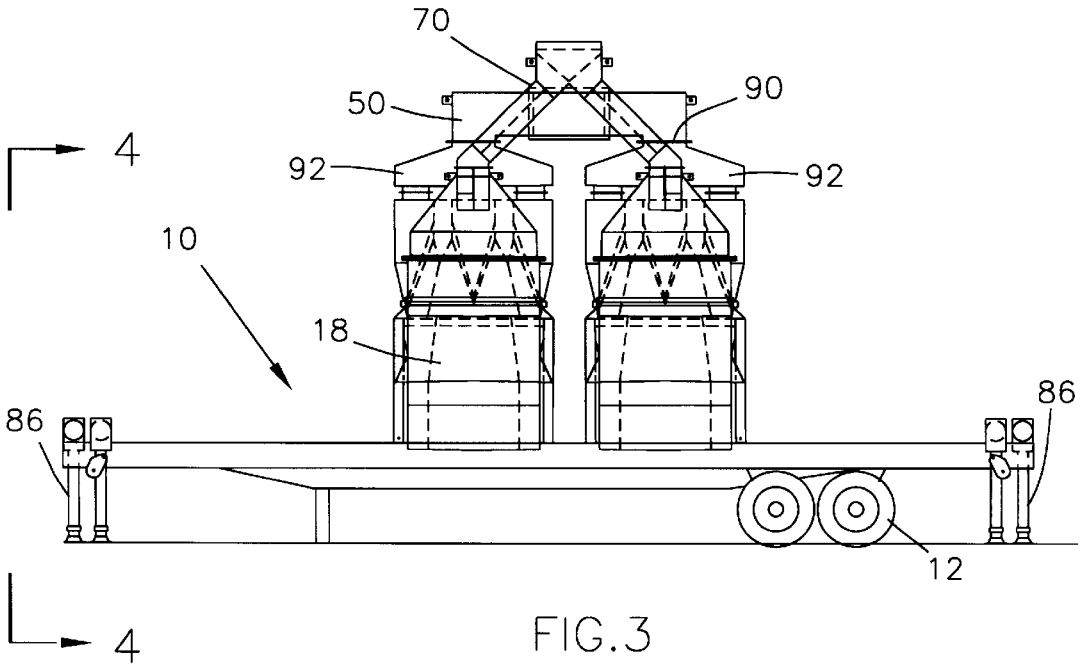
FIG. 3 is a side elevational view illustrating the classifiers and riffle "Y" duct in an upright operational position.
Figure 4:
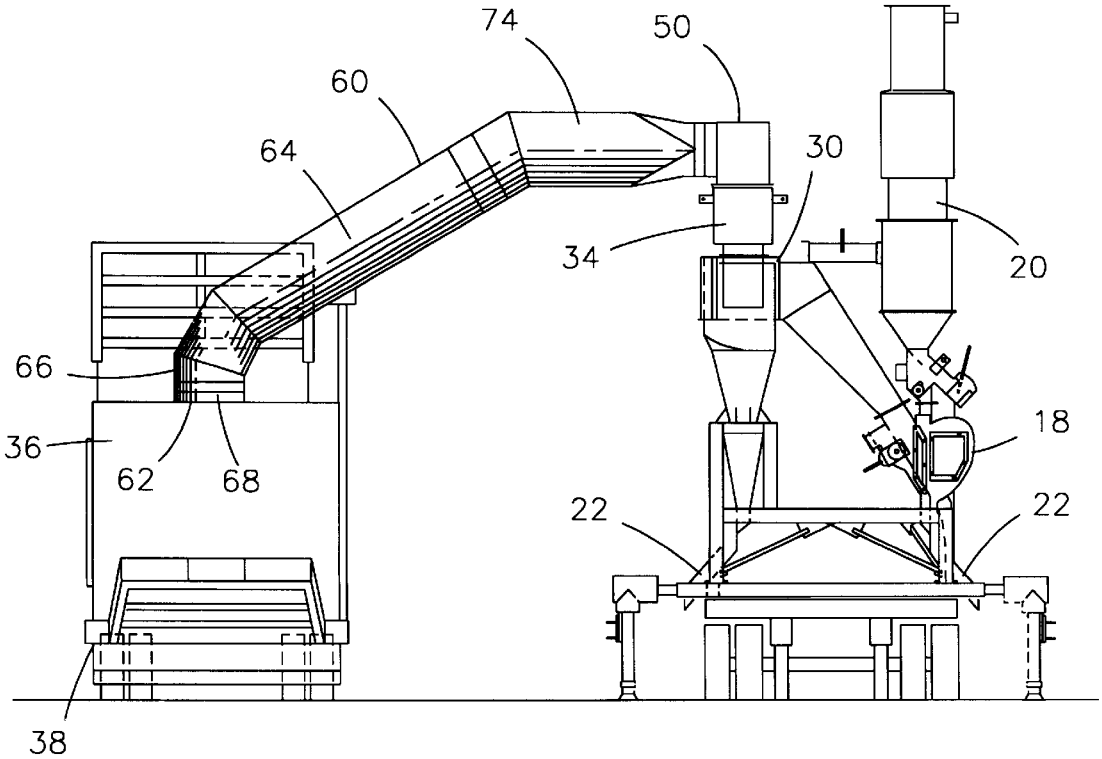
FIG. 4 is an end elevational view illustrating the mobile classifying system of the present invention in an upright operational position and coupled to an adjoining mobile baghouse.

Referring to FIGS. 1 and 2. there is provided a frame 14 which is 30 mounted to the flatbed for pivotal movement about a transverse axis Each frame 14 is generally rectilinear in configuration and has legs 16 for supporting the classifier and cyclones in their erect operational positions. Each unit includes at least one classifier 18 which may be of the Buell type previously described having an aggregate inlet 20 adjacent an upper end thereof when in upright operational position as illustrated in FIG. 3 and 4 and a lower discharge 22 for the coarse particles. Each classifier 18 also includes a primary air inlet 23, a fines outlet 24, a duct 26 interconnecting the fines outlet and the fines inlets of a pair of cyclone separators 28, and a choke plate 27 for developing the curtain of aggregate and controlling the thickness and spread of the curtain across the width of the classifier. Cyclone separators 28 are conventional separators, each having a fines inlet 30 adjacent its upper end ill communication with a duct 26, a fines discharge 32 adjacent their lower ends and a dust outlet 34 for flowing dust separated from the fines to a portable baghouse 36 mounted on a second flatbed trailer 38.

It will be appreciated from a review of FIGS. 1 and 2 that the separate forward and rearward units are pivotally mounted to the trailer bed and when mounted in a horizontal transport position leave an open area in the central portion of the trailer bed. This central area of the trailer 10 is used to mount and transport various ancillary parts of the classifier and fines separation systems including the major duct. Work necessary for supplying aggregate to each of the classifiers 18 of the units and communicating the dust from the cyclone separators 28 to the portable baghouse 36. Thus, disposed in a generally horizontal transport position between the units when lying in their transport positions is a riffle splitter "Y" duct 40 having an aggregate inlet 42 and a pair of aggregate outlets 44 at distal ends of the secondary ducts 46 in communication with the inlet 42. With this "Y" duct disposed on the flatbed in a horizontal position. a large, generally rectilinear duct 50 is disposed on top of the "Y" duct, with suitable separation members 52 therebetween. The generally rectilinear duct 50 has a dust outlet 54 and a pair of dust inlets 56 at its opposite ends. The duct 50 is located centrally generally along the longitudinal centerline of the trailer 10 and overlies the "Y" duct 40. A duct 60 for interconnecting the outlet 54 of the duct 50 (when operational) and the inlet 62 to the portable baghouse 36 is provided in two sections, i.e., a long section 64 and a short section 74. The long section 64 has a bend 66 at one end terminating in an outlet 68 for connection with the baghouse inlet and an opposite end 70 for connection with the outlet 72 of the short section 74. The inlet 76 of the short section 74 is coupled to the outlet 54 of duct 50 in use. For transport, the long section 64 may be positioned on top of the legs of the "Y" duct and to one side of the rectilinear duct 50, with the angled end face of section 64 face-down toward the trailer bed. The short section 74 may, during transport, have its outlet end 72 positioned below the duct 50 with the transition end 80 thereof disposed on the bed of the trailer 10. It will be appreciated that these parts in the central area of the trailer 10 are secured during transport of the trailer 10 to the job site by suitable tie-downs, e.g., chains. Likewise, the units at opposite ends of the trailer 10 are secured in the horizontal position as illustrated by similar tie-downs.

At opposite ends of the trailer 10, there are provided telescoping outriggers 82 and 84. Each telescoping outrigger 82 and 84 has a telescoping leg 86. Furthermore, the baghouse trailer 38 also mounts a series of filter bags 87 within a closed compartment in communication with a suction fan 88 also mounted on the baghouse trailer 38. A conveyor is disposed below the baghouse for removing the dust.

Figure 5:
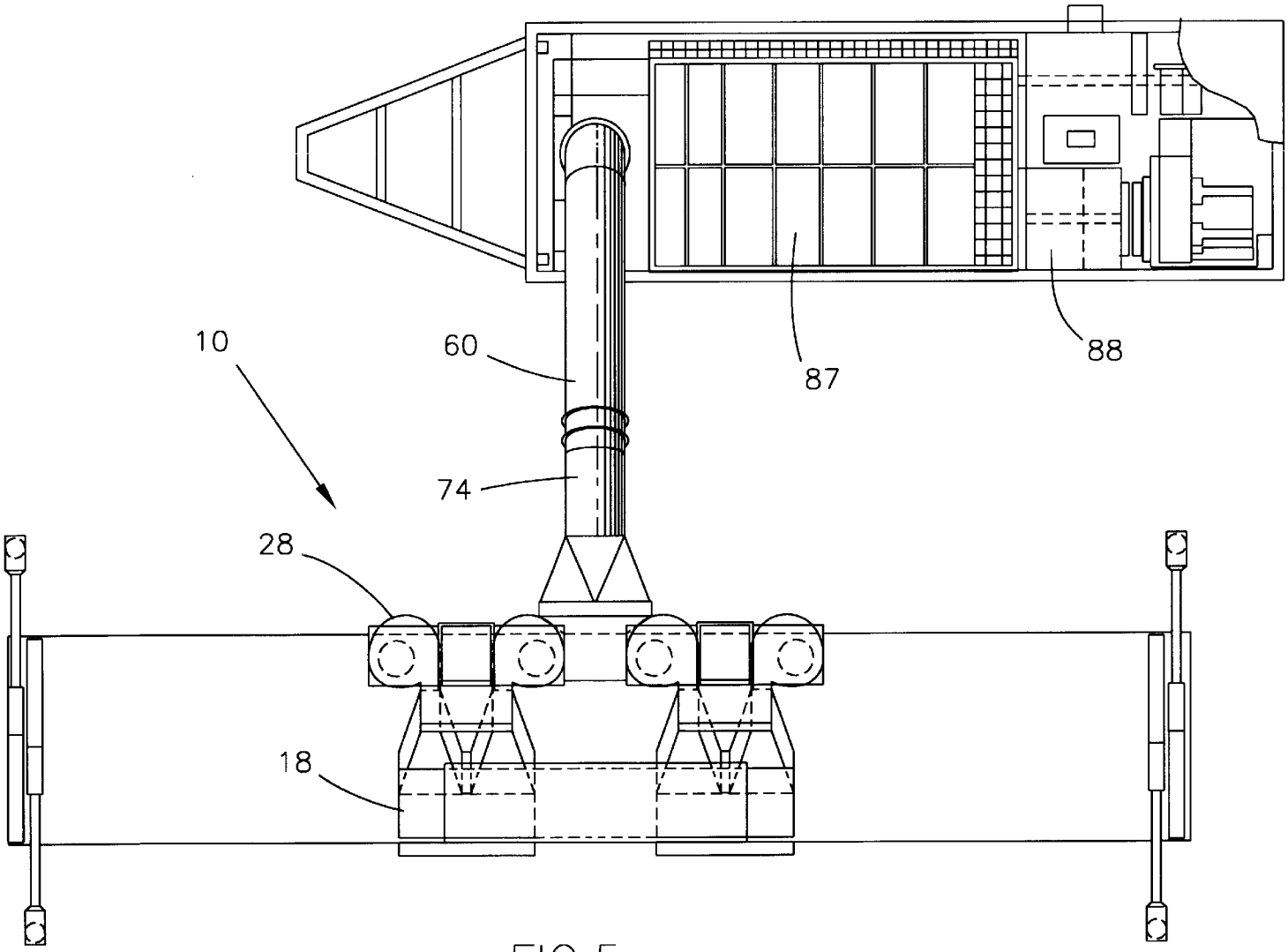
FIG. 5 is a plan view of the system in its upright operational position.

In using the present invention, the trailers 10 and 38 are driven to the selected job site. The forward and rearward units and ancillary ducts during transport lie in the positions illustrated in FIGS. 1 and 2 as described above. At the job site, the outriggers 82 and 84 are extended and the legs 86 of the outriggers 82 and 84 are likewise extended to engage the ground and thereby provide stability to the trailer 10 during separating operations as illustrated in FIGS. 4 and 5. After all of the tie-downs have been removed or detached, a crane is used to remove the duct work from the area between the units and set that duct work aside during erection of the units. Once set aside, it will be appreciated that each of the unite may be, by use of the crane, pivoted toward one another from the generally horizontal transport position to the generally vertical upright erected position as illustrated in FIG. 3. Suitable points of securement are provided along the bed of the trailer 10 to releasably secure the units in the upright position. Once secured, the riffle splitter "Y" duct 40 may be hoisted by the crane and connected to the longitudinally adjacent classifiers 18. That is, the duct 40 is disposed such that the two outlet ends 44 are connected to the two inlet ends 20 of the classifiers 18f and 18r. Additionally, the rectilinear duct 50 may be disposed on top of the cyclones 28 with each inlet 56 coupled to the outlet 90 of a plenum 92 overlying each pair of cyclones 28. Subsequently, and by use of the crane, the short transition section 74 may be coupled at its opposite ends 72 and 76 to the rectilinear duct 50 and the long duct section 64. The angled end of the short duct section 64 is then coupled to the inlet to the baghouse 36.

It will thus be apparent that aggregate may be fed through the inlet 42 of the "Y" duct for flowing aggregate into the classifiers 18f and 18r. The system is placed under negative pressure by the primary fain 88 drawing air into the system principally through the primary air inlet 23. The coarse particle discharges are via the ducts 22 onto suitable conveyors, not shown. The fines separated from the aggregate by the classifiers 18 are transported through the fines outlet 24, the interconnecting ducts 26 and the fines inlet 30 for flow into the cyclones 28. The material separated from the fines is discharged through the lower cyclone discharge outlets 32 and the dust therefrom flows through the ducts 50, 74, 64 and into the baghouse 36. As noted previously, the baghouse 36 has a conveyor underlying the chamber in which the bags 87 are disposed for receiving the dust materials and conveying them to a suitable container.

After use, a reverse procedure is employed to reconfigure the units and ducts for transport. Thus, a crane is deployed to disconnect the ducts 40 and 50 from the classifiers 18 and cyclones 28, respectively, as well as disconnect the duct 64 from the duct 50 and the baghouse 36. With the fasteners securing the units in their upright operational positions released except for the pivotal mounting of the frames 14 to the trailer bed, a crane may be used to pivot the units from their upright operational positions illustrated in FIGS. 3–5 to their generally horizontal transport positions as illustrated in FIGS. 1–2. Suitable tie-downs are then used to secure the units in their transport positions. It will be appreciated that the classifier 18, cyclones 28 and ducts 26 interconnecting those elements on each unit are pivoted unitarily on the associated frame 14. Once the units are secured, the crane is used to load the ducts 40, 50, 64 and 74 onto the flatbed between the units. Again, suitable tie-downs are used to secure the ducts 40, 50, 64 and 74 to the trailer. After retracting the outriggers 82 and 84, the trailer 10 is thus ready for travel to a further job site. It will be appreciated that hydraulic units can be pivotally mounted on the trailer 10 and the frames 14 to displace the frames 14 between the horizontal and vertical positions.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A mobile system for classifying particulate material, said mobile system comprising:

a trailer;

wheels mounted on said trailer for transporting said trailer to a job site; and a first classification unit pivotally carried by said trailer for pivotal movement between a generally horizontal transport position on said trailer to an upright operational position on said trailer, said first classification unit including a first classifier having means for classifying said particulate material including, in said upright operational position thereof, a material inlet at an upper end of said first classifier for receiving said particular material, a coarse particle discharge for discharging coarse particles of said particulate material from said first classifier, and a fines discharge for discharging fines of said particulate material from said first classifier;

said first classification unit further including a first separator coupled with said first classifier for pivotal movement therewith between said horizontal transport position and said upright operational position of said first classification unit on said trailer, said first separator having a fines separation system including a fines inlet for receiving fines from said fines discharge of said first classifier, a fines discharge for discharging said fines from said first separator, and a dust discharge for discharging dust separated from said fines.

2. A mobile system according to claim 1, wherein said first separator is a cyclone separator having an upper end and a lower end when said first classification unit is in said horizontal transport position, said dust discharge of said first separator being at said upper end, said fines discharge of said first separator being at said lower end, and said fines inlet of said first separator being between said tipper and lower ends.

3. A mobile system according to claim 1 wherein said first classification unit further includes a frame pivotally connected to said trailer, said first classifier and said first separator being carried by said frame for pivotal movement therewith.

4. A mobile system according to claim 3 wherein said fines discharge for said first classifier and said fines inlet to said first separator are connected by a duct carried by said frame for pivotal movement therewith between said horizontal transport position and said upright operational position on said trailer.

5. A mobile system according to claim 1, further comprising a second classification unit pivotally carried by said trailer for pivotal movement between a generally horizontal transport position on said trailer and an upright operational position on said trailer, said second classification unit including a second classifier having means for classifying particulate material including, in said upright operational position thereof, a material inlet at an upper end of said second classifier for receiving said particulate material, a coarse particle discharge for discharging coarse particles of said particulate material and a fines discharge for discharging fines of said particulate material, said second classification unit further including a second separator coupled with said second classifier for pivotal movement therewith between said horizontal transport position and said upright operational position of said second classification unit on said trailer, said second separator having a fines separation system including a fines inlet for receiving fines from said fines discharge of said second classifier, a fines discharge for discharging said fines from said second separator, and a dust discharge for discharging dust separated from said fines.

6. A mobile system according to claim 5, further comprising first and second frames pivotally carried by said trailer, said first classifier and said first separator being pivotally carried by said first frame for pivotal movement therewith, said second classifier and said second separator being pivotally carried by said second frame for pivotal movement therewith.

7. A mobile system according to claim 6 wherein said first frame, first classifier and first separator of said first classification unit and said second frame, second classifier and second separator of said second classification unit are pivotally mounted on said trailer at longitudinally spaced positions therealong so as to define a longitudinally extending area on said trailer between said first and second classification units when disposed in their respective horizontal transport positions, said mobile system further comprising a generally Y-shiped duct carried by said trailer in said area during transport thereof, said Y-shaped duct being demountable from said area and said trailer for superposition over said material inlets to said first and second classifiers when pivoted to their upright operational positions to distribute particulate material from said Y-shaped duct to said material inlets.

8. A mobile system according to claim 6 wherein said first frame, first classifier and first separator of said first classification unit and said second frame, second classifier and second separator of said second classification unit are pivotally mounted on said trailer at longitudinally spaced positions therealong so as to define a longitudinally extending area on said trailer between said first and second classification units when disposed in said horizontal transport positions, said mobile system further comprising ducting carried by said trailer in said open area during transport thereof and being demountable from said area for securement to said first and second classifiers and said first and second separators when pivoted to their upright operational positions, said first classification unit and said second classification unit lying at least in part in said area when pivoted from said horizontal transport positions to said upright operational positions.

9. A mobile system according to claim 8 wherein said first classification unit and said second classification unit are pivoted in opposite directions when pivoted from their respective horizontal transport positions to their respective upright operational positions.

10. A mobile system according to claim 9, further comprising a generally Y-shaped duct carried by said trailer in said area during transport thereof, said Y-shaped duct being demountable from said area and said trailer for superposition over said material inlets to said first and second classifiers when pivoted to their upright operational positions to distribute particulate material from said Y-shaped duct to said material inlets.

11. A mobile system according to claim 10 further comprising a rectilinear duct carried by said trailer in said area during transport thereof, said rectilinear duct being demountable from said trailer and said area for superpositioning over said dust discharges of said first and second separators when said first and second classification units are pivoted to their respective upright operational positions.

12. A mobile system according to claim 8 wherein said first and second classifiers are disposed on one side of said trailer when in their respective horizontal transport and upright operational positions and wherein said separators are disposed on an opposite side of said trailer when in their respective horizontal transport and upright operational positions.

13. A method of erecting a mobile system for classifying particulate material, said mobile system including a trailer with wheels for transporting said mobile system between job sites, and a first classification unit pivotally carried by said trailer for pivotal movement between a generally horizontal transport position on said trailer to an upright operational position on said trailer, said first classification unit having a first classifier coupled to a first separator, said first classifier having a material inlet for receiving said particulate material, a coarse particle discharge for discharging course particles of said particulate material from said first classifier, and a fines discharge for discharging fines of said particulate material to a fines inlet of said first separator, said method comprising the steps of:

moving said trailer to a job site while said first classification unit is disposed in said horizontal transport position on said trailer; and at said job site, pivoting said first classification unit to said upright operational position on said trailer while said first classifier and said first separator remain coupled.

14. A method according to claim 13 wherein said step of moving said first classification unit to said upright operational position comprises simultaneously pivoting said first classifier and said first separator from positions on opposite sides of said trailer to upright erect positions on said trailer.

15. A method according to claim 13, wherein the mobile system further includes a second classification unit pivotally carried by said trailer for pivotal movement between a generally horizontal transport position on said trailer to an upright operational position on said trailer, said second classification unit having a second classifier coupled to a second separator, said second classifier having a material inlet for receiving particulate material, a coarse particle discharge for discharging course particles of said particulate material from said second classifier, and a fines discharge for discharging fines of said particulate material to said second separator, wherein said second classification unit is disposed in said horizontal transport position during said moving step, said method further comprising the step of pivoting said second classification unit to said upright operational position on said trailer at said job site.

16. A method according to claim 15 wherein said step of pivoting, said first and second classification units into said upright operational positions includes pivoting said first classifier and said first separator about a first common pivotal axis and pivoting said second classifier and said second separator about a second common pivotal axis.

17. A method according to claim 13, wherein said first classification unit further includes a frame pivotally connected to said trailer, said first classifier and said first separator being carried by said frame for pivotal movement therewith during said pivoting step.

18. A method according to claim 17, wherein said fines discharge for said first classifier and said fines inlet of said first separator arc connected by a duct carried by said frame for pivotal movement therewith between said horizontal transport position and said upright operational position on said trailer.

19. A method according to claim 17, wherein said mobile system further includes a second classification unit pivotally carried by said trailer for pivotal movement between a generally horizontal transport position on said trailer to an upright operational position on said trailer, said second classification unit having a second classifier coupled to a second separator, said second classification unit being disposed in said horizontal transport position during said moving step, wherein said first and second classification units are pivotally mounted on said trailer at longitudinally spaced positions therealong so as to define a longitudinally extending area on said trailer between said first and second classification units when disposed in said horizontal transport positions, said mobile system further comprising ducting carried by said trailer in said area during said moving step, said ducting being moved from said area and secured to said first and second classifiers and said first and second separators after said pivoting step, said first and second classification units lying at least in part in said area when pivoted from said horizontal transport positions to said upright operational positions.

20. A method according to claim 19, wherein said first and second classification units arc pivoted in opposite directions when pivoted from their respective horizontal transport positions to their respective upright operational positions.

* * * * *